US010397727B1

(12) United States Patent
Schissler

(10) Patent No.: US 10,397,727 B1
(45) Date of Patent: Aug. 27, 2019

(54) AUDIO SOURCE CLUSTERING FOR A VIRTUAL-REALITY SYSTEM

(71) Applicant: FACEBOOK TECHNOLOGIES, LLC, Menlo Park, CA (US)

(72) Inventor: Carl Schissler, Redmond, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/165,965

(22) Filed: Oct. 19, 2018

(51) Int. Cl.
*H04S 3/00* (2006.01)
*H04S 7/00* (2006.01)

(52) U.S. Cl.
CPC ..... *H04S 7/303* (2013.01); *H04S 3/008* (2013.01); *H04S 2400/01* (2013.01); *H04S 2400/11* (2013.01); *H04S 2420/01* (2013.01)

(58) Field of Classification Search
CPC ..... H04R 3/04; H04R 2420/07; H04R 27/00; H04R 29/001; H04R 2201/401; H04R 2499/13; H04R 1/1008; H04R 1/1041; H04R 2201/107; H04R 2201/109; H04R 2499/10; H04R 5/033; H04R 2430/01; H04R 29/00; H04R 1/2811; H04R 1/403; H04R 1/406; H04R 2201/028; H04R 2203/12; H04R 2205/024; H04R 2227/001; H04R 227/005; H04R 2227/007; H04R 2460/07; H04S 3/00; H04S 3/02; H04S 5/005; H04S 5/02; H04S 7/302; H04L 61/308; H04N 7/15; H04N 7/181; H04W 4/02; H04W 84/18; G10L 19/008; H04M 1/03; H04M 1/6008; H04M 1/6041; H04M 9/082; G02B 2027/014; G02B 2027/0178; G02B 2027/0138; G02B 2027/0187; G02B 27/01; G02B 27/017; G02B 27/0172; G06F 3/011; G06F 3/012; G06F 3/013; G06F 3/016; G06F 3/017; G06T 19/006; G06T 19/20; G06T 2207/10004; G06T 2207/10028; G06T 2219/2004; G06T 7/62
USPC ..... 381/303, 61, 63, 300, 17–23, 309, 74
See application file for complete search history.

(56) References Cited

U.S. PATENT DOCUMENTS 9,426,598 B2 * 8/2016 Walsh ..... H04S 7/301
2008/0165979 A1 * 7/2008 Takumai ..... H04R 1/403 381/59
2013/0293530 A1 * 11/2013 Perez ..... G06K 9/00671 345/418

(Continued)

*Primary Examiner* — Lun-See Lao
(74) *Attorney, Agent, or Firm* — Morgan, Lewis & Bockius LLP

(57) ABSTRACT

A method clusters audio sources in virtual environments. The method is performed at a virtual-reality device displaying a virtual environment. The device identifies two audio sources in the virtual environment. For each of the two audio sources, the device determines a bounding box in the virtual environment. Each bounding box includes termination points for a respective plurality of rays emanating from a point in the virtual environment corresponding to the audio source. The device applies an overlap test to the bounding boxes to determine whether the two audio sources are in a same room. The device forms an angle according to rays from the location of the listener to the audio source points. When the two audio sources are in the same room and the angle is less than a predetermined threshold angle, the device clusters the two audio sources together, including rendering combined audio for the two audio sources.

20 Claims, 11 Drawing Sheets

(56) References Cited

U.S. PATENT DOCUMENTS

| | | | | |
|---|---|---|---|---|
| 2013/0328762 | A1* | 12/2013 | McCulloch | G02B 27/017 345/156 |
| 2016/0189426 | A1* | 6/2016 | Thomas | G06T 19/006 345/633 |
| 2018/0234765 | A1* | 8/2018 | Torok | H04R 3/12 |

* cited by examiner

Figure 3B

Definitions

320 → $\tilde{R}^t$ = bounding box at time $t = 0, 1, 2, \ldots$

322 → $R^t$ = smoothed bounding box at time $t = 0, 1, 2, \ldots$

324 → $\tilde{R}^t_{min}$ = minimum dimension of $\tilde{R}^t$

326 → $\tilde{R}^t_{max}$ = maximum dimension of $\tilde{R}^t$

328 → $R^t_{min}$ = minimum dimension of $R^t$

330 → $R^t_{max}$ = maximum dimension of $R^t$

Calculations for $t = 0$

340 → $R^0_{min} = \tilde{R}^0_{min}$

342 → $R^0_{max} = \tilde{R}^0_{max}$ for $t \geq 1$

344 → $R^t_{min} = \alpha_R R^{t-1}_{min} + (1 - \alpha_R)\tilde{R}^t_{min}$

346 → $R^t_{max} = \alpha_R R^{t-1}_{max} + (1 - \alpha_R)\tilde{R}^t_{max}$

AUDIO SOURCE CLUSTERING FOR A VIRTUAL-REALITY SYSTEM

TECHNICAL FIELD

The present disclosure relates generally to the field of stereophony, and more specifically to clustering multiple audio sources for users of virtual-reality systems.

BACKGROUND

Humans can determine locations of sounds by comparing sounds perceived at each ear. The brain can determine the location of a sound source by utilizing subtle intensity, spectral, and timing differences of the sound perceived in each ear.

The intensity, spectra, and arrival time of the sound at each ear is characterized by a head-related transfer function (HRTF) unique to each user.

In virtual-reality systems, it is advantageous to generate an accurate virtual acoustic environment for users that reproduce sounds for sources at different virtual locations to create an immersive virtual-reality environment. When there are many distinct sound sources, treating them all as separate sound sources is computationally complex, making it difficult to render all of the sounds in real-time. On the other hand, if many sound sources are combined, it creates a disparity between the visual location of objects in the VR world and the perceived auditory locations of the objects. Because of the complexity of having many audio sources, conventional approaches typically fail to provide a real-time VR environment with accurate source positioning.

SUMMARY

One solution to the problem includes determining when it is possible to cluster two or more audio sources of the virtual-reality acoustic environment together. By clustering the two or more audio sources, the user can hear the sources coming from a specific direction while reducing significant hardware resources and processing time.

A primary goal of a sound propagation and rendering system is the ability to handle a large number of sound sources. One way to increase the possible source count is to cluster nearby sources together, then simulate those sources together as a single proxy source. If a suitable clustering heuristic is chosen, the simulation time can be greatly reduced without significantly impacting quality. Clustering can be more aggressive for sources that are farther away or are in a different part of the environment than the listener. Clustering of sources is important for handling complex scenes. For instance, a game character may use several sound sources—footsteps, voice, gun, etc. Large scenes may have dozens of active characters, each with a few sound sources. Clustering enables these sources to be collapsed down to one source per character (or possibly combining multiple characters' sources), except where it would negatively impact the rendered audio.

In accordance with some embodiments, a method of clustering audio sources in virtual environments is performed at a virtual-reality device displaying a virtual environment. The device identifies two audio sources in the virtual environment. For each of the two audio sources, the device determines a respective bounding box in the virtual environment. The respective bounding box includes termination points for a respective plurality of rays emanating from a respective point in the virtual environment corresponding to the respective audio source. In some embodiments, rays are emitted from the surface of the source (e.g., a point, sphere, or other geometric shape). The device applies an overlap test to the bounding boxes to determine whether the two audio sources are in the same room. The device also identifies a location of a listener in the virtual environment, and determines an angle θ (e.g., a solid angle of the bounding box of the sources) according to rays from the location of the listener to the points in the virtual environment corresponding to the two audio sources. When the two audio sources are determined to be in the same room and the angle θ is less than a predetermined threshold angle $T_\theta$, the device clusters the two audio sources together, including rendering combined audio for the two audio sources, from a single cluster audio location. In some embodiments, the single cluster audio location is treated as if the sound (e.g., a mixture of the two sources) is emanating from both source locations. When the two audio sources are determined not to be in the same room or the angle θ is greater than the threshold angle $T_\theta$, the device does not cluster the two or more audio sources together, and renders audio for the virtual environment without combining audio for the two audio sources.

In some embodiments, applying the overlap test includes determining whether overlap between the two bounding boxes is more than a threshold fraction of each bounding box. In some embodiments, the bounding boxes are $R_1$ and $R_2$, and the device determines respective volumes $|R_1|_v$ and $|R_2|_v$ for the bounding boxes $R_1$ and $R_2$. The device also determining the volume $|R_1 \cap R_2|_v$ of the overlap between the two bounding boxes. Using this data, the device computes the minimum overlap value $$\min\left(\frac{|R_1 \cap R_2|_v}{|R_1|_v}, \frac{|R_1 \cap R_2|_v}{|R_2|_v}\right).$$

The two audio sources are determined to be in the same room when the minimum overlap value exceeds a threshold fraction $T_R$.

Generally, embodiments recheck the clustering conditions at regular intervals (e.g., every 100 ms). In some embodiments, after clustering the two audio sources together and passage of a time interval Δt, the device determines updated respective volumes $|R_1'|_v$ and $|R_2'|_v$ for updated bounding boxes $R_1'$ and $R_2'$ corresponding to the two audio sources. The device also determines an updated volume $|R_1' \cap R_2'|_v$ of overlap between the two updated bounding boxes. The device then computes the updated minimum overlap value $$\min\left(\frac{|R_1' \cap R_2'|_v}{|R_1'|_v}, \frac{|R_1' \cap R_2'|_v}{|R_2'|_v}\right).$$

When the updated minimum overlap value is less than a predetermined split threshold fraction $T_R^{split}$ the device de-clusters the two audio sources. The predetermined split threshold fraction $T_R^{split}$ is less than the threshold fraction $T_R$ (which prevents rapid switching back and forth between clustering and de-clustering). When the updated minimum overlap value is greater than the split threshold fraction $T_R^{split}$, the device maintains clustering of the two audio sources.

In some embodiments, each termination point of a respective ray emanating from a respective point corresponding to a respective audio source is a location in the virtual environment where either (1) the respective ray encounters an object in the virtual environment or (2) the respective ray exits from the virtual environment. In some embodiments, the virtual environment has perpendicular coordinate axes, and each bounding box is a minimal axis-aligned rectangle containing the termination points of its respective plurality of rays. For example, the virtual environment may be surrounded by four walls that meet at right angles. The bounding boxes for the audio sources may be aligned to be parallel to the walls of the virtual environment.

In some embodiments, after clustering the two audio sources together and passage of a time interval $\Delta t$, the device reevaluates the angle test. In particular, the device computes an updated angle $\theta'$ according to rays from an updated location of the listener to updated points in the virtual environment corresponding to the two audio sources. When the updated angle $\theta'$ is greater than the predetermined split threshold angle $T_\theta^{split}$, the device de-clusters the two audio sources. The predetermined split threshold angle $T_\theta^{split}$ is greater than the threshold angle $T_\theta$ (which prevents rapid switching back and forth between clustering and de-clustering). When the updated angle $\theta'$ is less than the split threshold angle $T_\theta^{split}$, the device maintains clustering of the two audio sources.

In accordance with some embodiments, a method is performed at a virtual-reality device displaying a virtual scene. The method determines a bounding box of an acoustic space of the virtual scene. A listener of the virtual scene is located within the determined bounding box. In some embodiments, the bounding box of the listener is computed using the same method described herein to determine a bounding box of an audio source and/or an acoustic space. The method further determines one or more clustering metrics for two or more audio sources (distinct from the listener) of the virtual scene. The two or more audio sources are positioned within the acoustic space. When the one or more clustering metrics for the two or more audio sources satisfy clustering criteria, the method clusters the two or more audio sources together as a single audio source, and renders audio for the virtual scene. At least a portion of the rendered audio combines audio associated with the clustered two or more audio sources.

In accordance with some embodiments, a virtual-reality device includes one or more processors, memory, and one or more programs stored in the memory. The programs are configured to be executed by the one or more processors. The virtual-reality device determines a bounding box of an acoustic space of a virtual scene. The virtual scene is displayed by the virtual-reality device. A listener of the virtual scene is located within the determined bounding box. The virtual-reality device determines one or more clustering metrics for two or more audio sources, distinct from the listener, of the virtual scene. The two or more audio sources are positioned within the acoustic space. When the one or more clustering metrics for the two or more audio sources satisfy clustering criteria, the device clusters the two or more audio sources as a single audio source and render audio for the virtual scene. At least a portion of the rendered audio combines audio associated with the clustered two or more sources.

In accordance with some embodiments, a head-mounted display device includes one or more processors/cores and memory storing one or more programs configured to be executed by the one or more processors/cores. The one or more programs include instructions for performing the operations of any of the methods described herein. In accordance with some embodiments, a non-transitory computer-readable storage medium stores instructions that, when executed by one or more processors/cores of a head-mounted display device, cause the device to perform the operations of any of the methods described herein.

In another aspect, a head-mounted display device is provided and the head-mounted display device includes means for performing any of the methods described herein.

Thus, the disclosed embodiments provide an efficient way to cluster certain audio sources within a virtual environment, which enables the virtual reality system to provide a better user experience.

BRIEF DESCRIPTION OF DRAWINGS

For a better understanding of the various described embodiments, reference should be made to the Description of Embodiments below, in conjunction with the following drawings in which like reference numerals refer to corresponding parts throughout the figures and specification.

FIG. 3B provides the equations used by some embodiments to compute the smoothed bounding boxes.

Figure 1A:
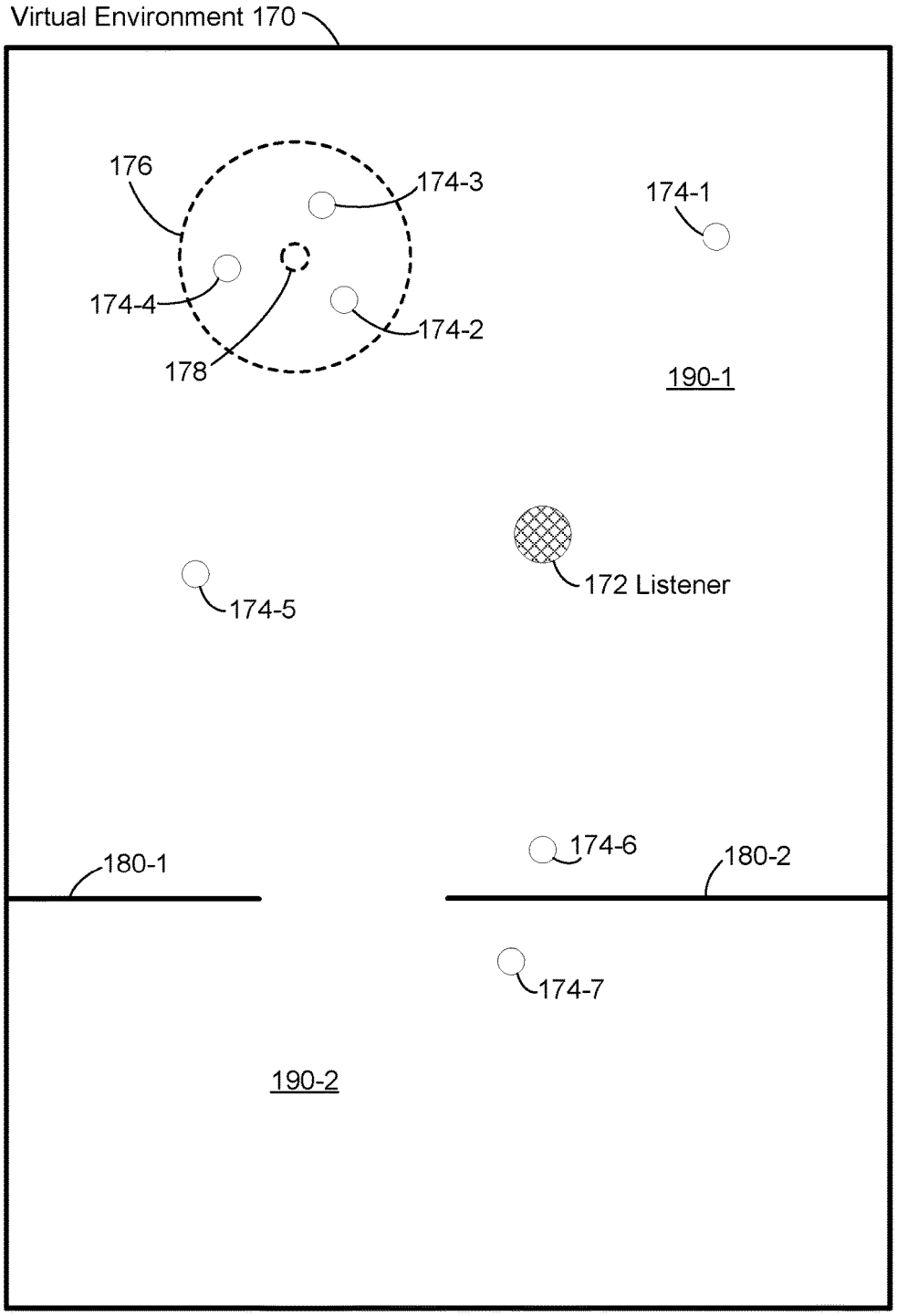
FIG. 1A shows a virtual-reality environment with multiple audio sources in accordance with some embodiments.

The figures depict embodiments of the present disclosure for purposes of illustration only. One skilled in the art will readily recognize from the following description that alternative embodiments of the structures and methods illustrated herein may be employed without departing from the principles, or benefits, of the disclosure described herein.

DETAILED DESCRIPTION

Reference will now be made to embodiments, examples of which are illustrated in the accompanying drawings. In the following description, numerous specific details are set forth in order to provide an understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

It will also be understood that, although the terms first and second are used, in some instances, to describe various elements, these elements should not be limited by these terms. These terms are used only to distinguish one element from another. For example, a first audio source could be termed a second audio source, and, similarly, a second audio source could be termed a first audio source, without departing from the scope of the various described embodiments. The first audio source and the second audio source are both audio source, but they are not the same audio source, unless specified otherwise.

The terminology used in the description of the various described embodiments herein is for the purpose of describing particular embodiments only and is not intended to be limiting. As used in the description of the various described embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, steps, operations, elements, and/or components, but do not preclude the presence or addition of one or more other features, steps, operations, elements, components, and/or groups thereof.

As used herein, the term "if" means "when" or "upon" or "in response to determining" or "in response to detecting" or "in accordance with a determination that," depending on the context. Similarly, the phrase "if it is determined" or "if [a stated condition or event] is detected" means "upon determining" or "in response to determining" or "upon detecting [the stated condition or event]" or "in response to detecting [the stated condition or event]" or "in accordance with a determination that [a stated condition or event] is detected," depending on the context.

A virtual-reality (VR) system simulates sounds that a user of the VR system perceives to have originated from sources at desired virtual locations of the virtual environment.

FIG. 1A shows a virtual-reality environment with multiple audio sources 174 in accordance with some embodiments. Also in this virtual environment 170 is a listener 172, as well as some virtual objects, including two walls 180-1 and 180-2. As illustrated in this virtual environment, the three sound sources 174-2, 174-3, and 174-4 can be considered as a cluster 176, with the sounds having a single location 178 (e.g., the union of the source geometries). In order to be placed in a cluster, the sound sources must satisfy certain criteria, as described below. The simple virtual environment 170 in FIG. 1A consists of two rooms 190-1 and 190-2. One of the criteria for clustering sound sources is to determine whether the sound sources are in the same room.

Figure 1B:
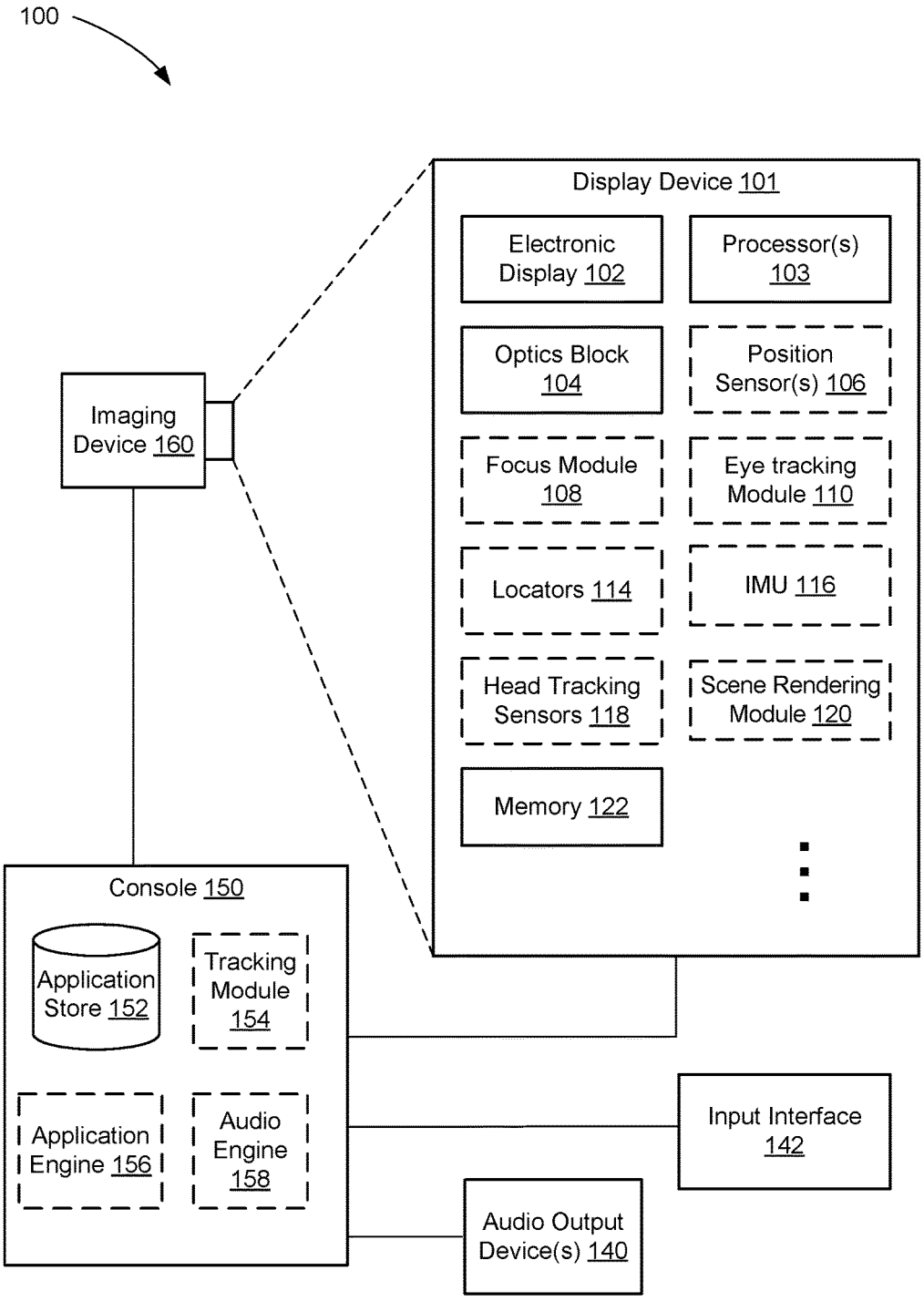
FIG. 1B is a block diagram of a virtual-reality system in accordance with some embodiments.

FIG. 1B is a block diagram of a virtual-reality system 100 in accordance with some embodiments. The virtual-reality system 100 shown in FIG. 1 includes a display device 101, an imaging device 160, and an input interface 142. In some embodiments, all of the display device 101, the imaging device 160, and the input interface 142 are coupled to a console 150.

Embodiments of the virtual-reality system 100 may include or be implemented in conjunction with an artificial reality system. Artificial reality is a form of reality that has been adjusted in some manner before presentation to a user, which may include virtual-reality (VR), augmented reality (AR), mixed reality (MR), hybrid reality, or some combination and/or derivative thereof. Artificial reality content may include completely generated content or generated content combined with captured (e.g., real-world) content. The artificial reality content may include video, audio, haptic feedback, or some combination thereof. Any of this may be presented in a single channel or in multiple channels (such as stereo video that produces a three-dimensional effect to the viewer). In some embodiments, artificial reality may be associated with applications, products, accessories, services, or some combination thereof, that are used, for example, to create content in an artificial reality and/or are otherwise used in (e.g., perform activities in) artificial reality. The artificial reality system that provides the artificial reality content may be implemented on various platforms, including a head-mounted display (HMD) connected to a host computer system, a standalone HMD, a mobile device, or a computing system.

While FIG. 1B shows a single display device 101, a single imaging device 160, and a single input interface 142, some embodiments include multiples of these components. For example, there may be multiple display devices, each having an associated input interface 142 and being monitored by one or more imaging devices 160. Each display device 101, input interface 142, and imaging device 160 communicates with the console 150. In alternative configurations, different and/or additional components may also be included in the system environment.

In some embodiments, the display device 101 is a head-mounted display that presents media to a user of the display device 101. The display device 101 may be referred to herein as a head-mounted display device. Examples of media presented by a display device 101 include one or more images, video, audio, or some combination thereof. In some embodiments, audio is presented via an external output device 140 (e.g., speakers and/or headphones) that receives audio information from the display device 101, the console 150, or both, and presents audio data based on the audio information. In some embodiments, the display device 101 immerses a user in a virtual environment.

In some embodiments, the display device 101 also acts as an augmented reality (AR) headset. In these embodiments, the display device 101 augments views of a physical, real-world environment with computer-generated elements (e.g., images, video, or sound). Moreover, in some embodiments, the display device 101 is able to cycle between different types of operation. Thus, the display device 101 operates as a virtual-reality (VR) device, an AR device, as glasses, or some combination thereof (e.g., glasses with no optical correction, glasses optically corrected for the user, sunglasses, or some combination thereof) based on instructions from the application engine 156.

In some embodiments, the display device 101 includes one or more of each of the following: an electronic display 102, processor(s) 103, an optics block 104, position sensors 106, a focus prediction module 108, an eye tracking module 110, locators 114, an inertial measurement unit 116, head tracking sensors 118, a scene rendering module 120, and memory 122. In some embodiments, the display device 101 includes only a subset of the modules described here. In some embodiments, display device 101 has different modules than those described here. Similarly, the functions can be distributed among the modules in a different manner than is described here.

One or more processors 103 (e.g., processing units or cores) execute instructions stored in the memory 122. The memory 122 includes high-speed random access memory, such as DRAM, SRAM, DDR RAM or other random access solid state memory devices, and may include non-volatile memory, such as one or more magnetic disk storage devices, optical disk storage devices, flash memory devices, or other non-volatile solid state storage devices. The memory 122, or alternatively the non-volatile memory device(s) within the memory 122, comprises a non-transitory computer readable storage medium. In some embodiments, the memory 122 or the computer readable storage medium of the memory 122 stores programs, modules, and data structures, and/or instructions for displaying one or more images on the display 102.

The display 102 displays images to the user in accordance with data received from the console 150 and/or the processors 103. In various embodiments, the display 102 comprises a single adjustable display element or multiple adjustable displays elements (e.g., a display for each eye of a user).

The optics block 104 directs light from the display 102 to an exit pupil, for viewing by a user, using one or more optical elements, such as Fresnel lenses, convex lenses, concave lenses, filters, and so forth, and may include combinations of different optical elements. The optics block 104 typically includes one or more lenses. In some embodiments, when the display 102 includes multiple adjustable display elements, the optics block 104 includes multiple optics blocks 104 (one for each adjustable display element).

The optics block 104 may be designed to correct one or more optical errors. Examples of optical errors include: barrel distortion, pincushion distortion, longitudinal chromatic aberration, transverse chromatic aberration, spherical aberration, comatic aberration, field curvature, astigmatism, and so forth. In some embodiments, content provided to the display 102 for display is pre-distorted, and the optics block 104 corrects the distortion when it receives image light from the display 102 generated based on the content.

Each state of the optics block 104 corresponds to a particular location of a focal plane of the display device 101. In some embodiments, the optics block 104 moves in a range of 5-10 mm with a positional accuracy of 5-10 μm. This can lead to 1000 states (e.g., positions) of the optics block 104. Any number of states could be provided. In some embodiments, fewer states are used. For example, in some cases, a first state corresponds to a focal plane located at infinity, a second state corresponds to a focal plane located at 2.0 meters (from a reference plane), a third state corresponds to a focal plane located at 1.0 meter, a fourth state corresponds to a focal plane located at 0.5 meters, a fifth state corresponds to a focal plane located at 0.333 meters, and a sixth state corresponds to a focal plane located at 0.250 meters.

Optional locators 114 are objects located in specific positions on the display device 101 relative to one another and relative to a specific reference point on the display device 101. A locator 114 may be a light emitting diode (LED), a corner cube reflector, a reflective marker, a type of light source that contrasts with an environment in which the display device 101 operates, or some combination thereof. In some embodiments, the locators 114 include active locators (e.g., an LED or other type of light emitting device) configured to emit light in the visible band (e.g., about 400 nm to 750 nm), in the infrared (IR) band (e.g., about 750 nm to 1 mm), in the ultraviolet band (e.g., about 100 nm to 400 nm), some other portion of the electromagnetic spectrum, or some combination thereof.

In some embodiments, the locators 114 are located beneath an outer surface of the display device 101, which is transparent to the wavelengths of light emitted or reflected by the locators 114 or is thin enough to not substantially attenuate the wavelengths of light emitted or reflected by the locators 114. In some embodiments, the outer surface or other portions of the display device 101 are opaque in the visible band of wavelengths of light. Thus, the locators 114 may emit light in the IR band under an outer surface that is transparent in the IR band but opaque in the visible band.

An inertial measurement unit (IMU) 116 is an electronic device that generates first calibration data based on measurement signals received from one or more head tracking sensors 118. One or more head tracking sensors 118 generate one or more measurement signals in response to motion of the display device 101. Examples of head tracking sensors 118 include accelerometers, gyroscopes, magnetometers, sensors suitable for detecting motion, sensors suitable for correcting errors associated with the IMU 116, or some combination thereof. The head tracking sensors 118 may be located external to the IMU 116, internal to the IMU 116, or some combination thereof.

Based on the measurement signals from the head tracking sensors 118, the IMU 116 generates first calibration data indicating an estimated position of the display device 101 relative to an initial position of the display device 101. For example, the head tracking sensors 118 include multiple accelerometers to measure translational motion (forward/back, up/down, left/right) and multiple gyroscopes to measure rotational motion (e.g., pitch, yaw, and roll). The IMU 116 can, for example, rapidly sample the measurement signals and calculate the estimated position of the display device 101 from the sampled data. For example, the IMU 116 integrates the measurement signals received from the accelerometers over time to estimate a velocity vector and integrates the velocity vector over time to determine an estimated position of a reference point on the display device 101. Alternatively, the IMU 116 provides the sampled measurement signals to the console 150, which determines the first calibration data. The reference point is a point that may be used to describe the position of the display device 101. The reference point is generally defined as a point in space. However, in practice the reference point is defined as a point within the display device 101 (e.g., the center of the IMU 116).

In some embodiments, the IMU 116 receives one or more calibration parameters from the console 150. As further discussed below, the one or more calibration parameters are used to maintain tracking of the display device 101. Based on a received calibration parameter, the IMU 116 may adjust one or more IMU parameters (e.g., sample rate). In some embodiments, certain calibration parameters cause the IMU 116 to update an initial position of the reference point so it corresponds to a next calibrated position of the reference point. Updating the initial position of the reference point as the next calibrated position of the reference point helps reduce accumulated error associated with the determined estimated position. The accumulated error, also referred to as drift error, causes the estimated position of the reference point to "drift" away from the actual position of the reference point over time.

An optional scene rendering module 120 receives content for the virtual scene from the application engine 156 and provides the content for display on the display 102. Additionally, the scene rendering module 120 can adjust the content based on information from the focus prediction module 108, a vergence processing module 112, the IMU 116, and/or head tracking sensors 118. For example, upon receiving the content from the engine 156, the scene rendering module 120 adjusts the content based on the predicted state (e.g., a state that corresponds to a particular eye position) of the optics block 104 received from focus the prediction module 108 by adding a correction or predistortion into rendering of the virtual scene to compensate or correct for the distortion caused by the predicted state of the optics block 104. The scene rendering module 120 may also add depth of field blur based on the user's gaze, vergence depth (or accommodation depth) received from a vergence processing module, or measured properties of the user's eye (e.g., three-dimensional position of the eye). Additionally, the scene rendering module 120 determines a portion of the content to be displayed on the display 102 based on one or more of the tracking module 154, the head tracking sensors 118, or the IMU 116, as described further below.

The imaging device 160 generates second calibration data in accordance with calibration parameters received from the console 150. The second calibration data includes one or more images showing observed positions of the locators 114 that are detectable by imaging device 160. In some embodiments, the imaging device 160 includes one or more cameras, one or more video cameras, other devices capable of capturing images including one or more locators 114, or some combination thereof. Additionally, the imaging device 160 may include one or more filters (e.g., for increasing signal to noise ratio). The imaging device 160 is configured to detect light emitted or reflected from the locators 114 in a field of view of the imaging device 160. In embodiments where the locators 114 include passive elements (e.g., a retroreflector), the imaging device 160 may include a light source that illuminates some or all of the locators 114, which retro-reflect the light towards the light source in the imaging device 160. The second calibration data is communicated from the imaging device 160 to the console 150, and the imaging device 160 receives one or more calibration parameters from the console 150 to adjust one or more imaging parameters (e.g., focal length, focus, frame rate, ISO, sensor temperature, shutter speed, or aperture).

The input interface 142 is a device that allows a user to send action requests to the console 150. An action request is a request to perform a particular action. For example, an action request may be to start or end an application or to perform a particular action within the application. The input interface 142 may include one or more input devices. Example input devices include a keyboard, a mouse, a game controller, or any other suitable device for receiving action requests and communicating the received action requests to the console 150. An action request received by the input interface 142 is communicated to the console 150, which performs an action corresponding to the action request. In some embodiments, the input interface 142 provides haptic feedback to the user in accordance with instructions received from the console 150. For example, haptic feedback is provided by the input interface 142 when an action request is received, or the console 150 communicates instructions to the input interface 142 causing the input interface 142 to generate haptic feedback when the console 150 performs an action.

The console 150 provides media to the display device 101 for presentation to the user in accordance with information received from the imaging device 160, the display device 101, and/or the input interface 142. In the example shown in FIG. 1B, the console 150 includes an application store 152, a tracking module 154, and an application engine 156. Some embodiments of the console 150 have different or additional modules than those described in conjunction with FIG. 1B. Similarly, the functions further described below may be distributed among components of the console 150 in a different manner than is described here.

When the application store 152 is included in the console 150, the application store 152 stores one or more applications for execution by the console 150. An application is a group of instructions, that, when executed by a processor (e.g., the processors 103), is used for generating content for presentation to the user. Content generated by the processor based on an application may be in response to inputs received from the user via movement of the display device 101 or the input interface 142. Examples of applications include gaming applications, conferencing applications, or video playback applications.

When the tracking module 154 is included in the console 150, the tracking module 154 calibrates the virtual-reality system 100 using one or more calibration parameters and may adjust one or more calibration parameters to reduce error in the determination of the position of the display device 101. For example, the tracking module 154 adjusts the focus of the imaging device 160 to obtain a more accurate position for the observed locators 114 on the display device 101. Moreover, calibration performed by the tracking module 154 also accounts for information received from the IMU 116. Additionally, if tracking of the display device 101 is lost (e.g., the imaging device 160 loses line of sight of at least a threshold number of the locators 114), the tracking module 154 re-calibrates some or all of the system components.

In some embodiments, the tracking module 154 tracks the movement of the display device 101 using calibration data from the imaging device 160. For example, tracking module 154 determines positions of a reference point on the display device 101 using observed locators from the calibration data from the imaging device 160 and a model of the display device 101. In some embodiments, the tracking module 154 also determines positions of the reference point on the display device 101 using position information from the calibration data from the IMU 116 on the display device 101. In some embodiments, the tracking module 154 uses portions of the first calibration data, the second calibration data, or some combination thereof, to predict a future location of the display device 101. The tracking module 154 provides the estimated or predicted future position of the display device 101 to the application engine 156.

The application engine 156 executes applications within the virtual-reality system 100 and receives position information, acceleration information, velocity information, predicted future positions, or some combination thereof for the display device 101 from the tracking module 154. Based on the received information, the application engine 156 determines content to provide to the display device 101 for presentation to the user, such as a virtual scene. For example, if the received information indicates that the user has looked to the left, the application engine 156 generates content for the display device 101 that mirrors or tracks the user's movement in the virtual environment. Additionally, the application engine 156 performs an action within an application executing on the console 150 in response to an action request received from the input interface 142 and provides feedback to the user that the action was performed. The provided feedback may be visual or audible feedback via the display device 101 or the haptic feedback via the input interface 142.

In some embodiments, the display device 101 includes a front rigid body and a band that goes around a user's head (not shown). The front rigid body includes one or more display elements corresponding to the display 102, the IMU 116, the head tracking sensors 118, and the locators 114. In this example, the head tracking sensors 118 are located within the IMU 116. In some embodiments where the display device 101 is used in AR and/or MR applications, portions of the display device 101 may be at least partially transparent (e.g., an internal display or one or more sides of the display device 101).

A position, an orientation, and/or a movement of the display device 101 is determined by a combination of the locators 114, the IMU 116, the head tracking sensors 118, the imagining device 160, and the tracking module 154, as described above in conjunction with FIG. 1B. Portions of a virtual scene presented by a display device 101 are mapped to various positions and orientations of the display device 101. Thus, a portion of the virtual scene currently viewed by a user is determined based on the position, orientation, and movement of the display device 101. After determining the portion of the virtual scene being viewed by the user, the virtual-reality system 100 may then determine a location or an object within the determined portion at which the user is looking to adjust focus for that location or object accordingly.

To determine the location or object within the determined portion of the virtual scene at which the user is looking, the display device 101 may track the position and/or location of the user's eyes. Thus, in some embodiments, the display device 101 determines an eye position for each eye of the user. For example, the display device 101 tracks at least a subset of the three-dimensional position, roll, pitch, and yaw of each eye and uses these quantities to estimate a three-dimensional gaze point of each eye. Further, information from past eye positions, information describing a position of the user's head, and information describing a scene presented to the user may also be used to estimate the three-dimensional gaze point of an eye in various embodiments.

Figure 2:
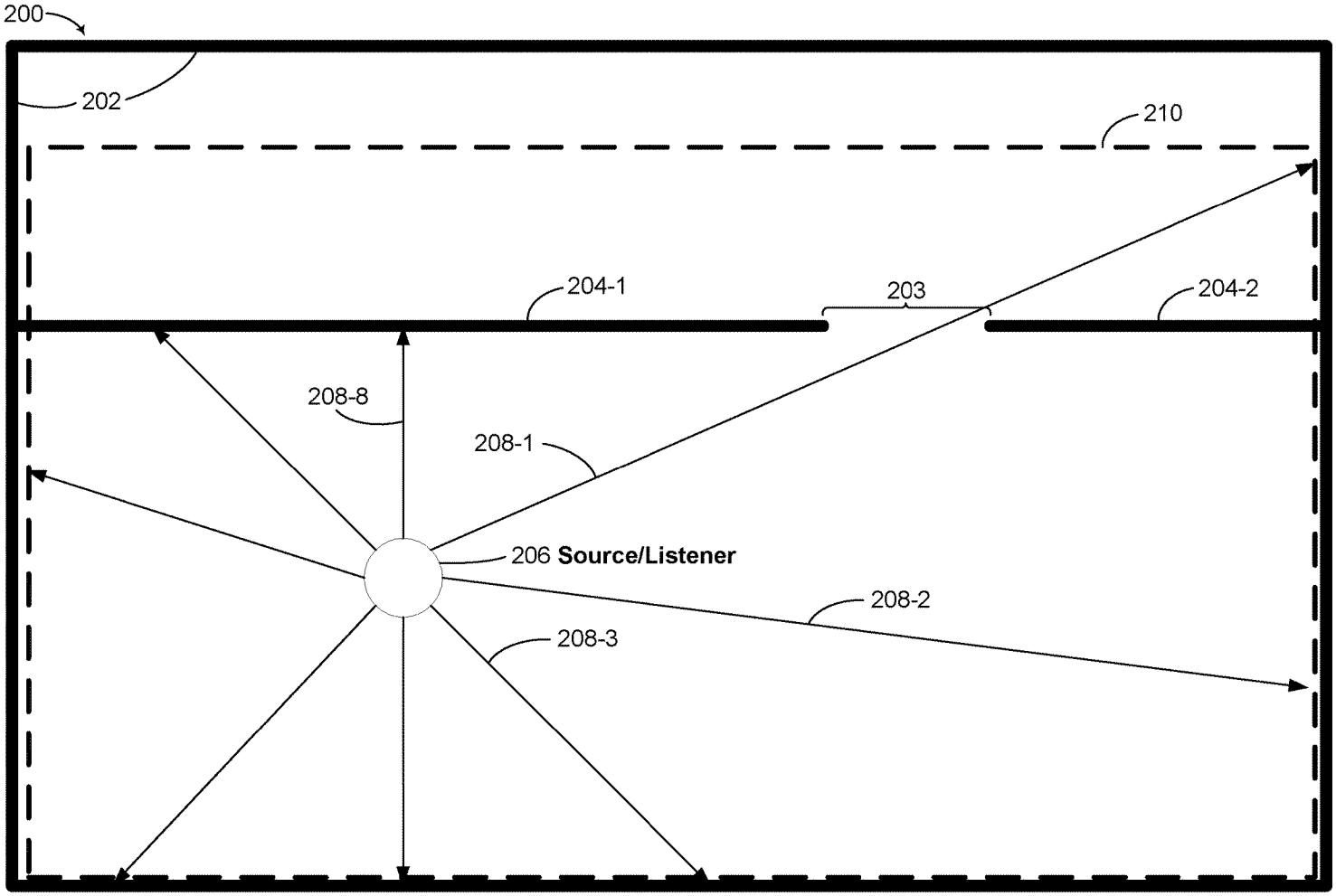
FIG. 2 illustrates an acoustic space of a virtual scene in accordance with some embodiments.

FIG. 2 illustrates a clustering approach for the acoustic space of a virtual scene in accordance with some embodiments. The acoustic space 200 may be bounded. The bounds may include bounding walls 202. In addition, the acoustic space 200 may include inner walls 204, such as the inner walls 204-1 and 204-2 in FIG. 2. In some instances, there are openings 203, such as a doorway or window. An acoustic space may include other objects as well, such as furniture (not depicted in FIG. 2).

For each audio source or listener 206, the process builds a bounding box 210 according to rays 208 originating from the source/listener 206. FIG. 2 depicts 8 rays (208-1, 208-2, 208-3, . . . , 208-8), but the number can be more or less. In some embodiments, the rays are distributed uniformly (e.g., every thirty degrees). In some embodiments, the rays are distributed randomly or pseudo-randomly. In some embodiments, the bounding box 210 is the smallest rectangle that contains all of the termination points of the rays 208.

Each ray 208 "travels" through the acoustic space 200 of the virtual scene until it hits an object or escapes the scene. When a ray hits an object, the hit point will contribute to the room bounding box 210 (shown with a dashed line pattern). An axis-aligned bounding box 210 encloses all of the ray hit points, and is chosen to be minimal in size. In some embodiments, this axis-aligned bounding box 210 is later used to estimate a smoothed bounding box 312 using the room information from previous simulation updates. This is described in more detail in relation to FIGS. 3A and 3B.

The number of rays influences the quality of the estimated bounding box. If there are not enough rays, the bounding box may not be an accurate representation of the room because of missing features (e.g., open ceilings). However, when there are too many rays, the sampling of the room may become computationally expensive while providing little additional value. In addition, using too many rays can lead to bounding boxes 210 that are too large. Some embodiments use ten rays 208 to balance quality and performance.

In some embodiments, the rays 208 terminate at the first object they encounter. In some embodiments, the rays are allowed to "bounce" one or more times after hitting a first object in the scene. In some embodiments, acoustic properties of objects in the scene are used to determine how much sound (if any) bounces off of an object and the direction of the acoustic bounces.

Figure 3A:
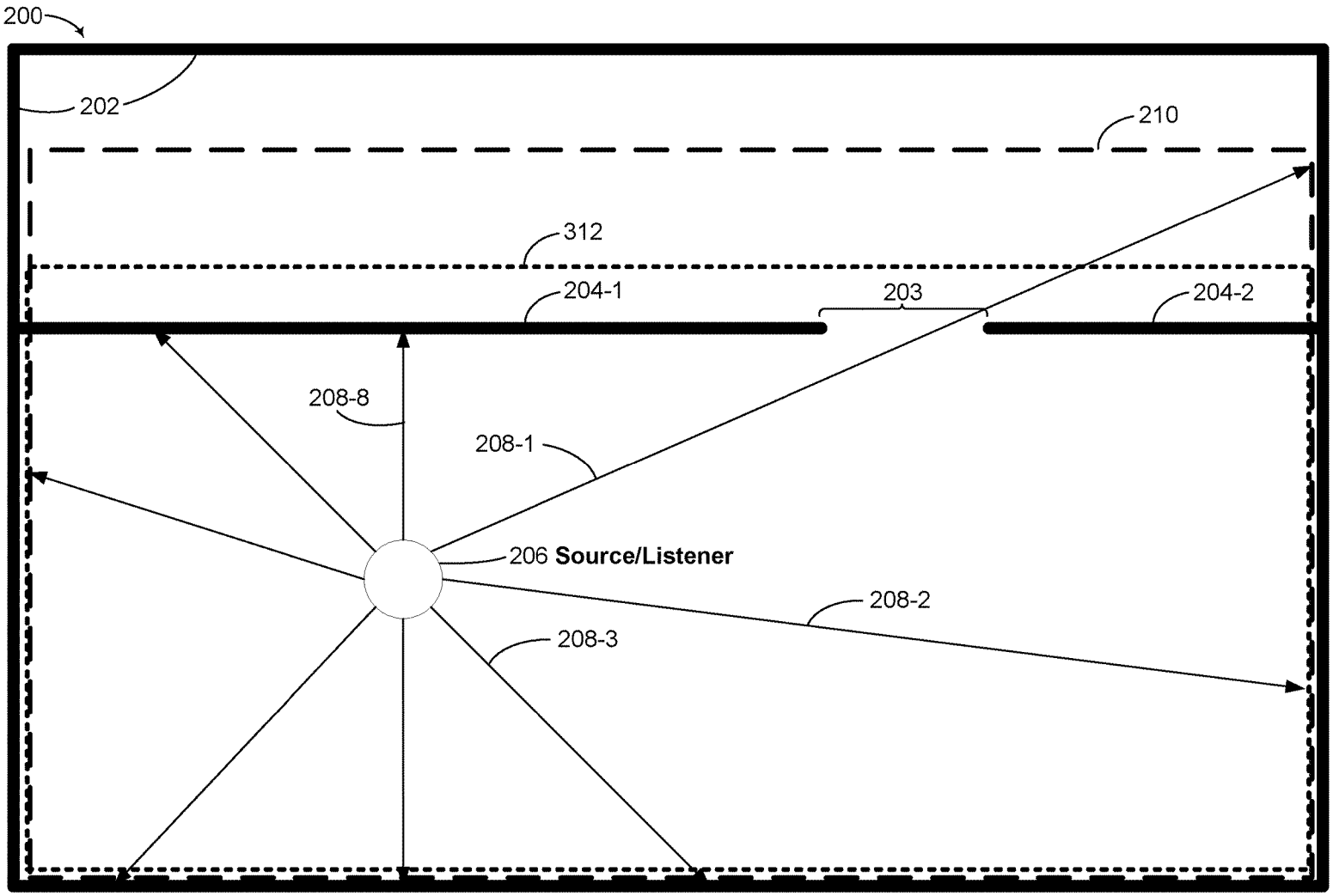
FIG. 3A illustrates the acoustic space of FIG. 2 with an additional smoothed bounding box in accordance with some embodiments.

FIG. 3A shows the same acoustic space 200 as FIG. 2, but includes a smoothed bounding box 312. The smoothed bounding box 312 is computed from the current bounding box and from the bounding box of the previous iteration.

Some embodiments apply exponential smoothing to the bounding box to ensure that the estimated room bounding box does not change abruptly or vary significantly over time. Exponential smoothing can also improve the quality of the room estimation.

FIG. 3B provides details of a smoothing process applied in some embodiments. Because the listener, the audio sources, and the other objects in the virtual scene can move, the bounding box is recomputed at regular time intervals (e.g., every 100 milliseconds). Smoothing incorporates data from the previous bounding box into the current estimate.

As indicated in FIG. 3B, $\tilde{R}^t$ is (320) the initial bounding box 210 at time t, computed using the rays 208. $R^t$ is (322) the smoothed bounding box 312 at time t, which is computed as described below. The bounding boxes each have minimum/maximum points that describe the box. For example, a cube with an edge length of 1 centered at the origin will have minimum/maximum points of (−0.5, −0.5, −0.5) and (0.5, 0.5, 0.5). Smoothing is computed based on the minimum/maximum points of the respective bounding boxes. In the calculations, the subscripts "min" and "max" designate the minimum and maximum extents for the bounding boxes, as specified in equations 324, 326, 328, and 330.

At time t=0, there is no previous iteration, so the dimensions of the smoothed bounding box $R^0$ are the same as the dimensions of the bounding box $\tilde{R}^0$, as specified in equations 340 and 342.

For t≥1, some embodiments use the recurrence relations 344 and 346 to compute the dimensions of the smoothed bounding box $R^t$. The recurrence relations use a convex combination of the previous smoothed bounding box 312 and the current bounding box 210. The value of $\alpha_R$ (which is in the range of 0.0 to 1.0) influences how quickly the smoothed bounding box adapts to changes in the scene. When $\alpha_R$ is close to zero, the scene changes are recognized quickly. When $\alpha_R$ is close to 1, the response is slow because the smoothed bounding box is weighted primarily by the previous smoothed bounding box. Embodiments typically use a value for $\alpha_R$ that is not near one of the extremes.

Some embodiments include data from two or more previous iterations in the calculation of the smoothed bounding box.

Although the discussion with respect to FIGS. 3A and 3B uses only a two-dimensional view (i.e., the bounding box is a rectangle), some embodiments extend this to create three-dimensional bounding boxes. To create appropriate 3D bounding boxes, a larger number of rays 208 is required.

Figure 4:
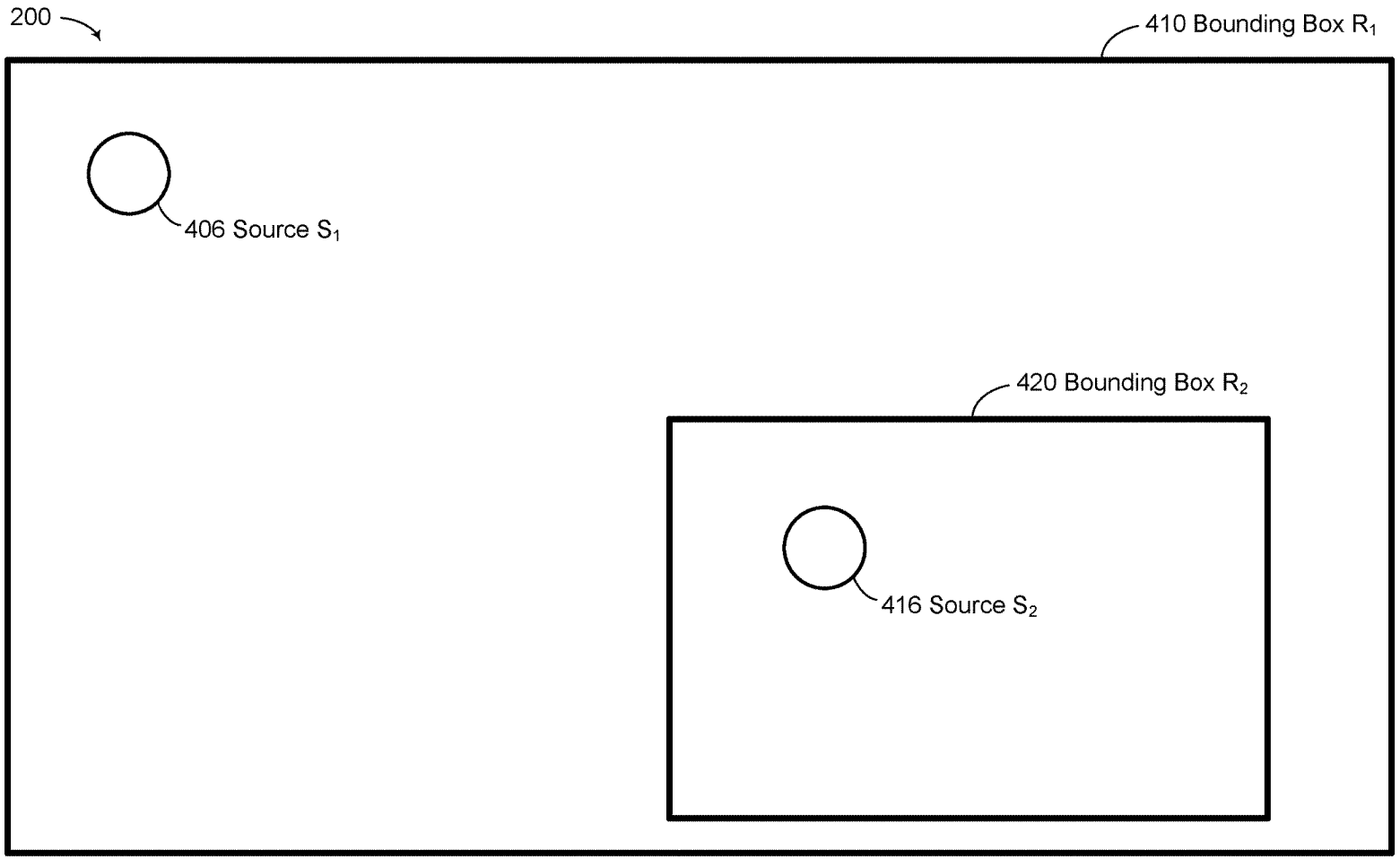
FIG. 4 illustrates computing a first cluster metric for an acoustic space of a virtual scene with multiple sound sources in accordance with some embodiments.

FIG. 4 illustrates computing a first cluster metric for an acoustic space of a virtual scene with multiple sound sources in accordance with some embodiments. The first cluster metric determines how much overlap there is between two bounding boxes relative to the sizes of the bounding boxes. If two bounding boxes are substantially the same, then they will satisfy the first cluster metric. If there is substantially no overlap, then the bounding boxes will not satisfy the first cluster metric. Just having substantial overlap, however, is not enough to satisfy the first cluster metric, as illustrated by the two bounding boxes $R_1$ 410 and $R_2$ 420 in FIG. 4. In this case, the second bounding box $R_2$ is entirely within the first bounding box $R_1$, but the bounding boxes are very different.

One way to account for this is to compare the size of the overlap to the sizes of bounding boxes themselves. In order to satisfy the first cluster metric, the overlapping portion must be a threshold percentage of the bounding boxes themselves.

In FIG. 4, the acoustic space 200 includes a first source $S_1$ 406, which is enclosed in a first bounding box 410, and a second source $S_2$ 416, which is enclosed in a second bounding box 420. Some embodiments use the following equation to determine whether the two audio sources may be clustered:

$$\min\left(\frac{|R_1 \cap R_2|_v}{|R_1|_v}, \frac{|R_1 \cap R_2|_v}{|R_2|_v}\right) > T_R.$$

In this equation, $|X|_v$ indicates the volume (e.g., area) of any region X. $T_R$ is the value of a predefined overlap threshold, which indicates how much the bounding boxes should overlap as a fraction of their volumes. When both of the fractions exceed the threshold $T_R$, the sources are assumed to be in the same room. The value of $T_R$ influences how aggressive the clustering will be across different audio sources. A higher threshold value means that two sources must have similar bounding boxes in order to be clustered together. However, if the threshold is set too high, it would limit the amount of clustering performed. A lower threshold value increases the amount of clustering performed, but can create strange behavior when it is too small (e.g., clustering sources together through walls). Some embodiments use a threshold value of 0.5 as a compromise between the two extremes.

With a threshold of 0.5, the bounding boxes $R_1$ and $R_2$ in FIG. 4 would not satisfy the overlap test. Specifically, $R_1 \cap R_2 = R_2$, so the second fraction is 1.0. However, the second bounding box $R_2$ is only about 20% of the size of the first bounding box $R_1$, so $$\frac{|R_1 \cap R_2|_v}{|R_1|_v}, \frac{|R_2|_v}{|R_1|_v} \approx 0.2 < T_R.$$

The overlap test described here can be applied to either the bounding boxes (e.g., computed directly using the rays 208) or the smoothed bounding boxes, as described above in FIGS. 3A and 3B. Applying the overlap test is also described below with respect to FIGS. 6A-6D.

Figure 5:
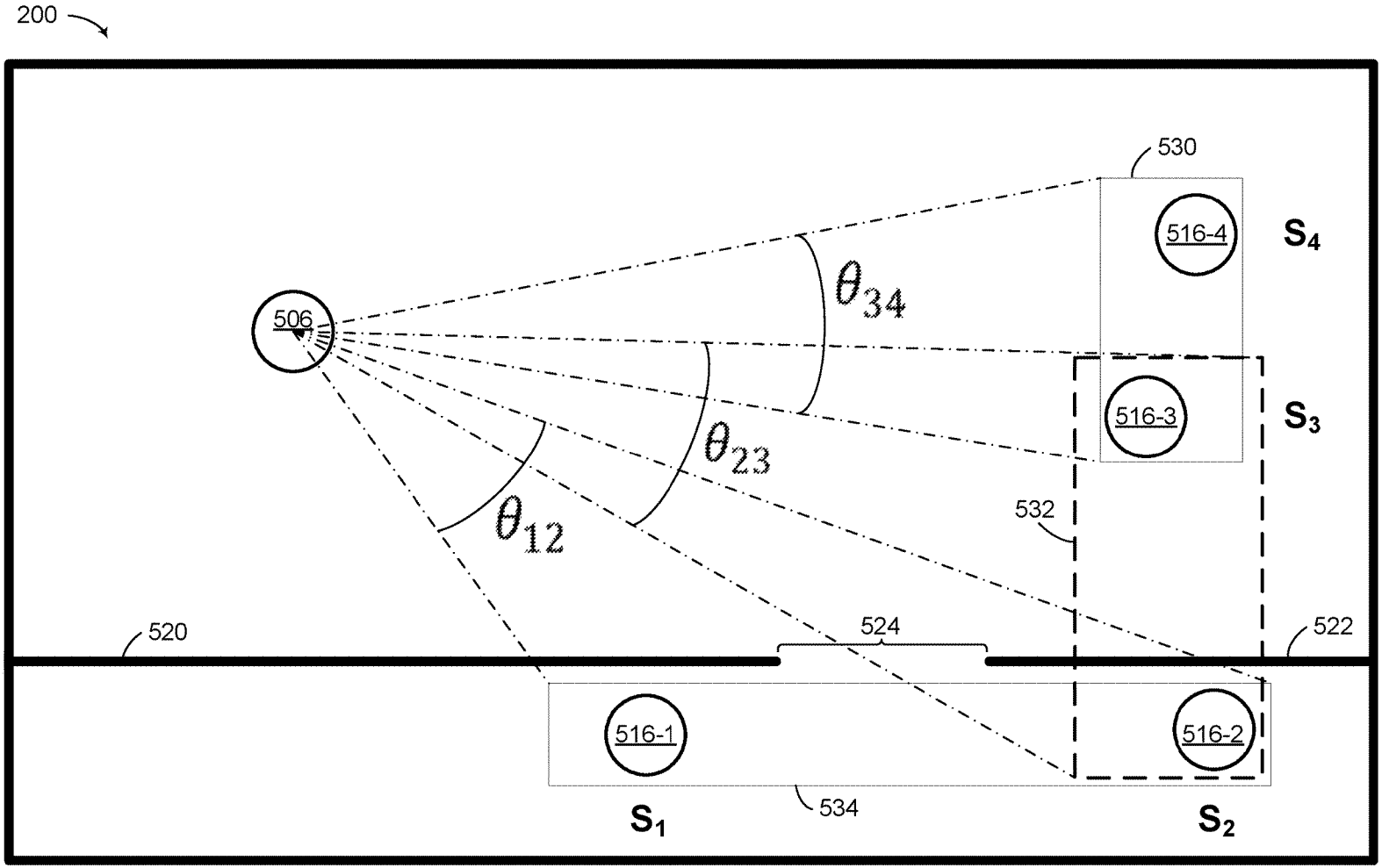
FIG. 5 illustrates computing a second cluster metric for an acoustic space of a virtual scene with multiple sound sources in accordance with some embodiments.
Figure 6A:
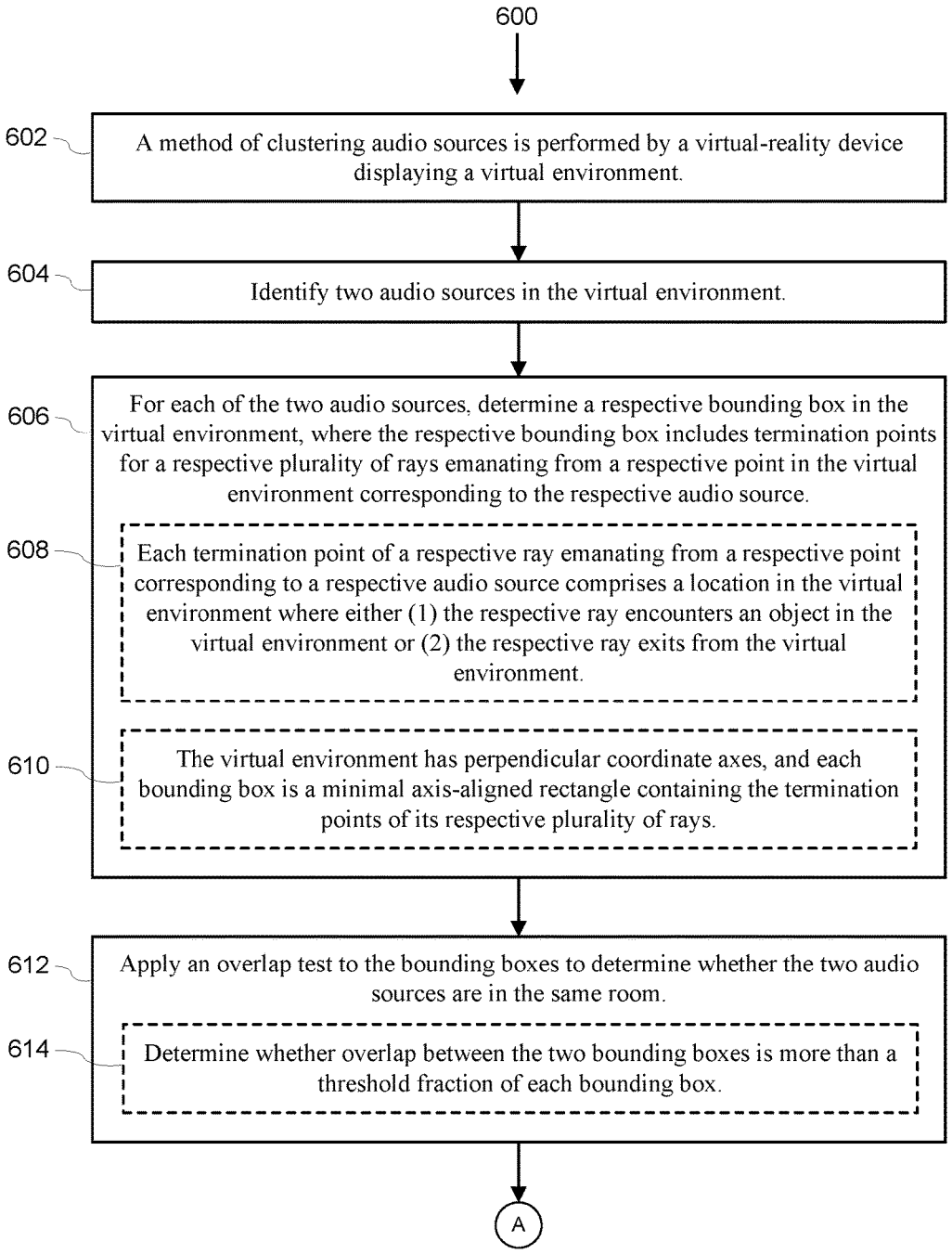
FIGS. 6A-6D provide a flow diagram of a method for clustering audio sources in accordance with some embodiments.
Figure 6B:
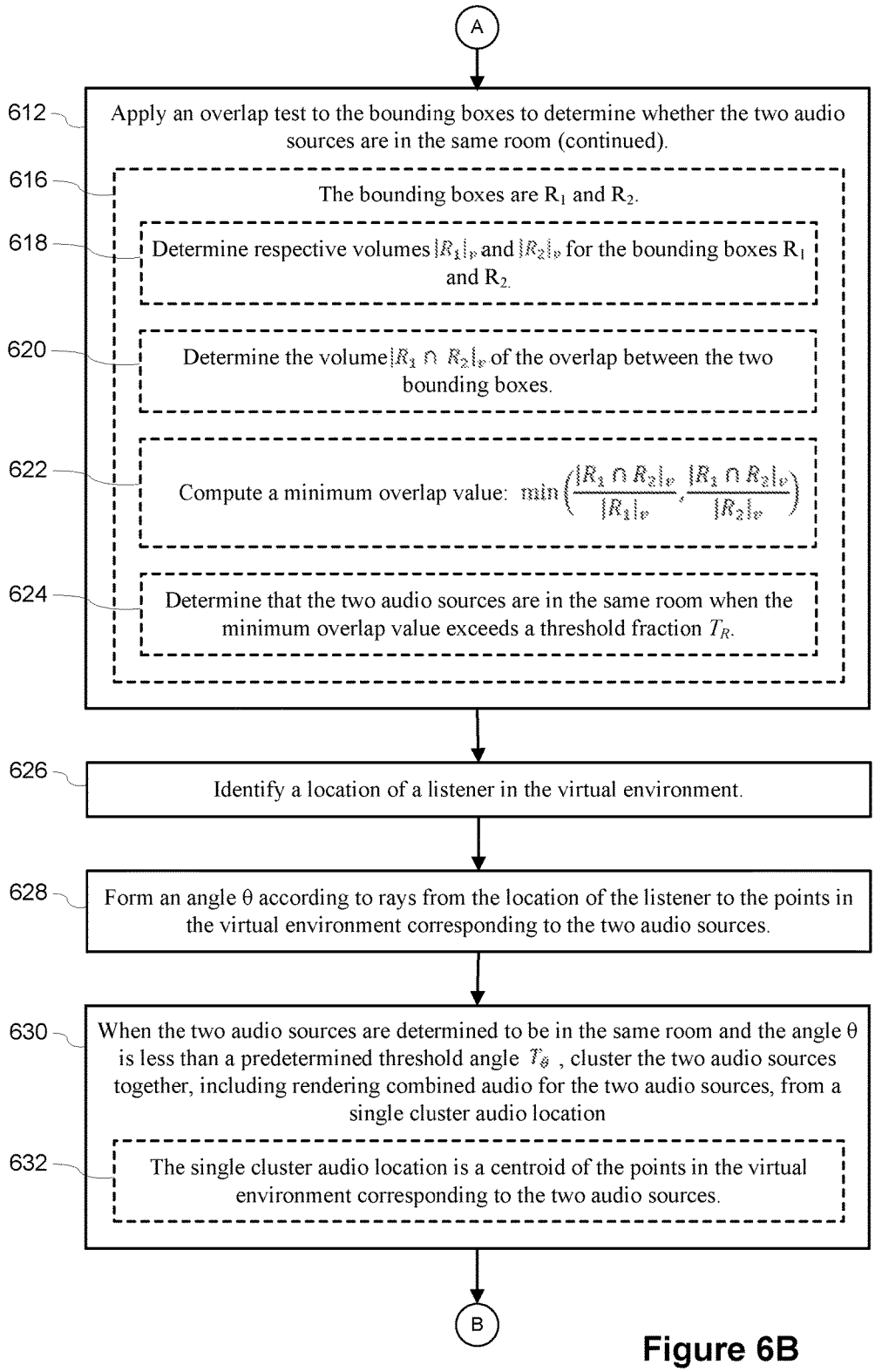
Figure 6C:
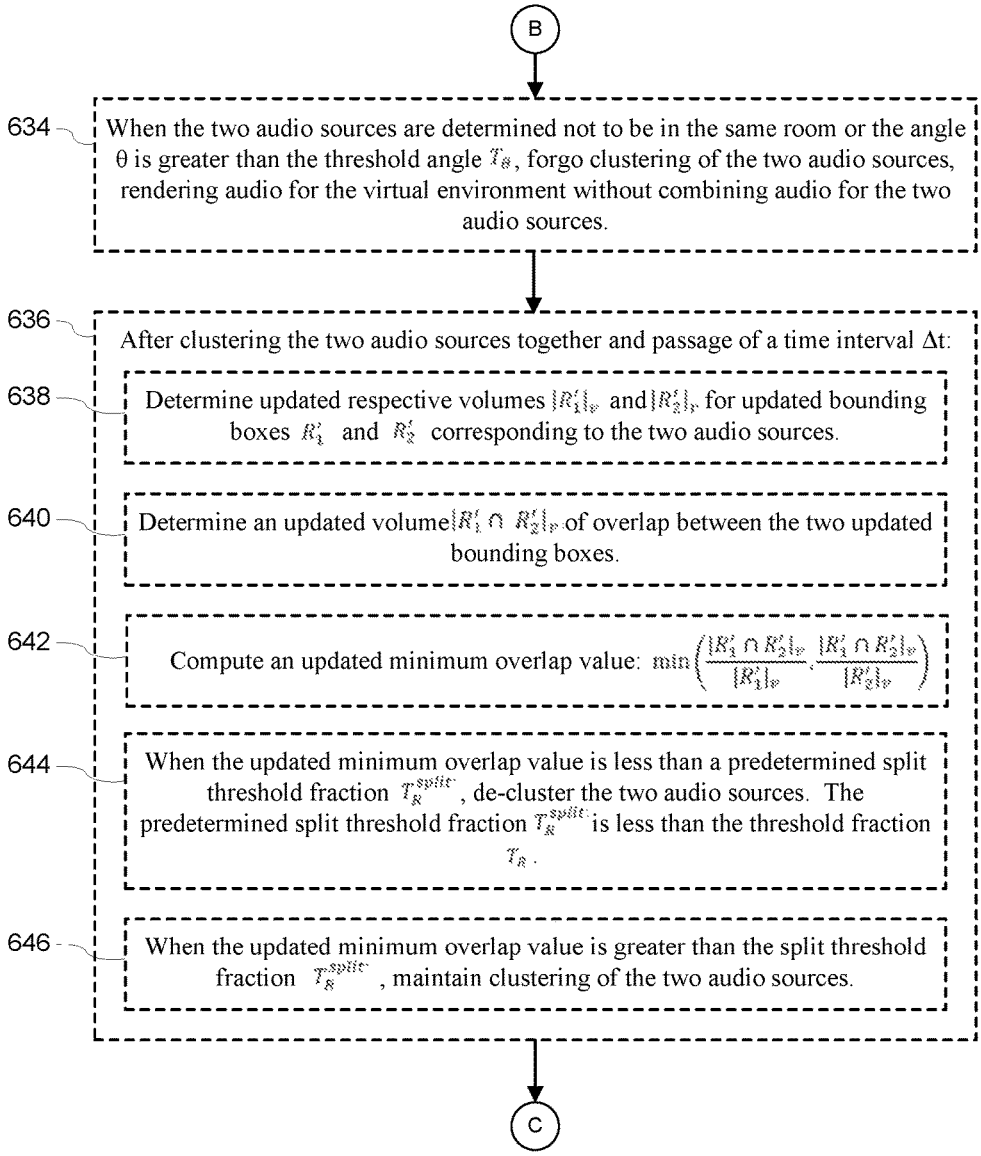
Figure 6D:
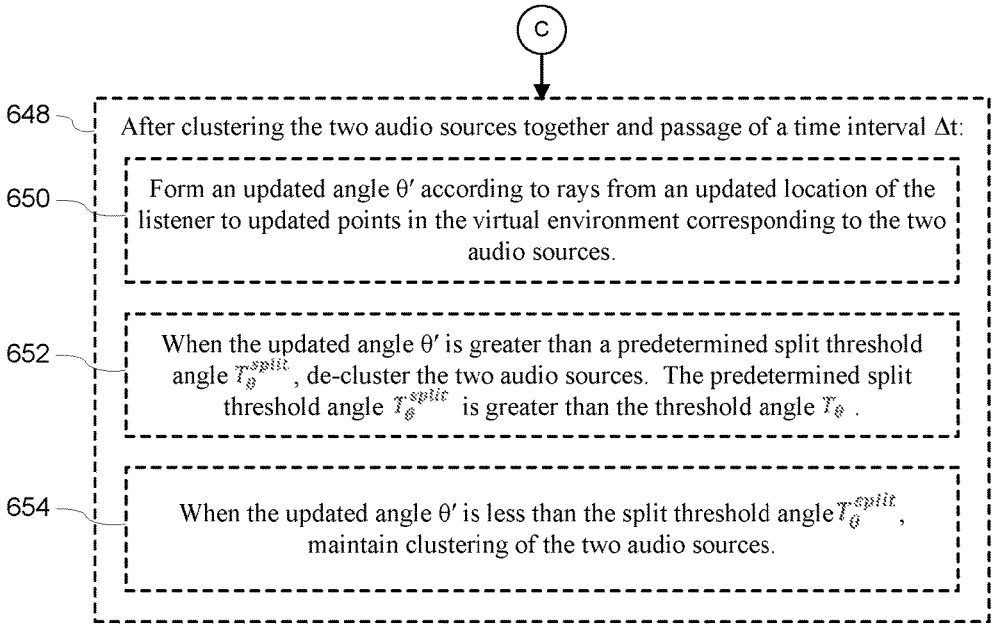

FIG. 5 illustrates computing a second cluster metric for an acoustic space 200 of a virtual scene with multiple sound sources in accordance with some embodiments. The acoustic space 200 includes a listener 506, multiple audio sources 516-1, 516-2, 516-3, and 516-4, and two walls 520 and 522. The second cluster metric is an angular test, which compares the orientations of each source with respect to the listener. If two audio sources have approximately the same angular orientation with respect to the listener, they can be clustered. A threshold angular size is specified, which determines whether clustering is appropriate. In some embodiments, the angle test is applied only when the listener 506 is in the same room as the audio sources to be tested (for example, by applying the overlap test using bounding boxes for the listener 506 and the audio sources). In some embodiments, the angle test computes the solid angle of a potential source cluster, and compares the solid angle to the specified threshold (the potential cluster may have two or more sources).

Some embodiments set the angular threshold at 10 degrees. When two audio sources have orientations that are less than 10° different, it is difficult for a listener to detect a location difference. However, angular differences greater than 10° become noticeable. Some embodiments use various values for the threshold value, such as an angular threshold between 8° and 12°.

In FIG. 5, sources $S_3$ 516-3 and $S_4$ 516-4 are within the same room, as determined by the room overlap test, so they form a potential cluster 530. Because the angle spread $\theta_{34}$ is less than the threshold (not depicted in FIG. 5), the audio sources $S_3$ and $S_4$ can be clustered. Regardless of whether the sources $S_2$ 516-2 and $S_3$ 516-3 pass the angle test (with proposed cluster 532), they cannot be clustered because they are not in the same room (they fail the overlap test). The sources $S_1$ 516-1 and $S_2$ 516-2 illustrate a different scenario. These two sources pass the overlap test because they are in the same room (different from the listener 506). Because of the separation of the sources $S_1$ and $S_2$, they fail the angle test for the potential cluster 534. Even though $S_1$ and $S_2$ do not pass the angle test, these sources can be still be clustered because the sound from both of these audio sources passes primarily through the opening 524 (indirectly) in order to reach the user. The opening 524 creates an angle that is much smaller than the spread angle would be without the walls 520 and 522. Therefore, some embodiments do not apply the angle test to a cluster that consists entirely of sources in a different room.

FIGS. 6A-6D provide a flow diagram for a method 600 of clustering audio sources in accordance with some embodiments. The method is performed (602) by a virtual-reality device 100 displaying a virtual environment 170. The virtual-reality device 100 has one or more processors and memory. The device 100 identifies (604) two (or more) audio sources 174 in the virtual environment 170. For each of the audio sources, the device 100 determines (606) a respective bounding box 210 in the virtual environment 170. The respective bounding box includes termination points for a respective plurality of rays 208 emanating from a respective point in the virtual environment 170 corresponding to the respective audio source 174. The process of building bounding boxes is described above with respect to FIGS. 2 and 3A.

In some embodiments, each termination point of a respective ray 208 emanating from a respective point corresponding to a respective audio source 174 comprises (608) a location in the virtual environment where either (1) the respective ray 208 encounters an object in the virtual environment or (2) the respective ray exits from the virtual environment. In some instances, the object is a wall, such as the wall 204-1 in FIG. 2. The ray 208-8 terminates when it reaches the wall. Rays 208 can terminate by reaching other objects as well (e.g., furniture in the virtual environment 170). FIGS. 2 and 3A illustrate a virtual environment 170 that is completely bounded (e.g., by the exterior walls 202). However, some virtual environments 170 have openings, such as an exterior window or an exterior doorway. In these cases, the ray is considered to terminate at the point where it "escapes" from the virtual environment 170

As illustrated in FIGS. 2 and 3A, some virtual environments have (610) perpendicular coordinate axes (as illustrated by the exterior walls 202). Each bounding box 210 is (610) a minimal axis-aligned rectangle containing the termination points of its respective plurality of rays 208.

The device 100 applies (612) an overlap test to the bounding boxes 210 to determine whether the two audio sources are in the same room. For example, in FIG. 1A, the three sources 174-2, 174-3, and 174-4 are all in the upper room 190-1. In some embodiments, the device 100 uses smoothed bounding boxes (e.g., the smoothed bounding box 312 in FIG. 3A) to perform the overlap test. One process for smoothing is described above with respect to FIG. 3B.

In some embodiments, the overlap test determines (614) whether the overlap between the two bounding boxes is more than a threshold fraction of each bounding box. This is described above with respect to FIG. 4. In some embodiments, the bounding boxes are labeled (616) as $R_1$ and $R_2$. In some embodiments, the overlap test includes the following steps: (1) determine (618) the respective volumes $|R_1|_v$ and $|R_2|_v$ for the bounding boxes $R_1$ and $R_2$; (2) determine (620) the volume $|R_1|_v \cap R_2|_v$ of the overlap between the two bounding boxes; (3) compute (622) the minimum overlap value $$\min\left(\frac{|R_1 \cap R_2|_v}{|R_1|_v}, \frac{|R_1 \cap R_2|_v}{|R_2|_v}\right);$$

and (4) determine (624) that the two audio sources are in the same room when the minimum overlap value exceeds a predefined threshold fraction $T_R$. This technique of measuring overlap acts indirectly to determine whether the two audio sources are in the same room. When the overlap test is applied in only two dimensions (as depicted in FIG. 4), the "volume" of a region or a bounding box is the area. When the overlap test is applied in three dimensions, the "volume" of a region or bounding box is a 3-dimensional volume.

Although described with respect to two audio sources, the same methodology can be applied to three or more audio sources. In some embodiments, when there are three or more audio sources, they are all considered to be in the same room when every pair of the three or more sources satisfies the overlap test.

In addition to the overlap test, embodiments apply an angle test, which measures the angle between the two sources from the perspective of the listener. This is illustrated in FIG. 5 above. To compute an angle, the device first identifies (626) the location of the listener 172 in the virtual environment 170. The device then measures (628) the angle θ formed according to rays from the location of the listener to the points in the virtual environment corresponding to the two audio sources. Audio sources may have arbitrary geometry, so the device measures the solid angle of the bounding box for the sources.

When the two audio sources 174 are determined to be in the same room and the angle θ is less than the predetermined threshold angle $T_\theta$, the device clusters (630) the two audio sources together, including rendering combined audio for the two audio sources, from a single cluster audio location. In some embodiments, the single cluster audio location is (632) a centroid of the points in the virtual environment corresponding to the two audio sources.

Conversely, when the two audio sources are determined not to be in the same room or the angle θ is greater than the threshold angle $T_\theta$, the device forgoes (634) clustering the two audio sources. In this case, the device renders audio for the virtual environment without combining audio for the two audio sources.

Clustering audio sources is not a one-time event. Because the listener can move and objects in the virtual environment can move (e.g., audio sources), clustering has to be reevaluated dynamically. The process to recheck clustering is typically applied at regular intervals (e.g., once every 100 milliseconds). Some embodiments apply cluster recalibration more frequently. When the clustering algorithm is reapplied, old clusters can be broken up, and new clusters can be created. A given cluster may lose some audio sources and gain some other audio sources. In general, the clustering algorithm reapplies both the overlap test and the angle test.

In some embodiments, after clustering the two audio sources together and passage of a time interval Δt, the device performs (636) these steps: (1) determine (638) updated respective volumes $|R_1'|_v$ and $|R_2'|_v$ for the updated bounding boxes $R_1'$ and $R_2'$ corresponding to the two audio sources; (2) determine (640) an updated volume $|R_1' \cap R_2'|_v$ of overlap between the two updated bounding boxes; and compute (642) an updated minimum overlap value $$\min\left(\frac{|R_1' \cap R_2'|_v}{|R_1'|_v}, \frac{|R_1' \cap R_2'|_v}{|R_2'|_v}\right).$$

When the updated minimum overlap value is less than a predetermined split threshold fraction $T_R^{split}$, the device de-clusters (644) the two audio sources. The predetermined split threshold fraction $T_R^{split}$ is less than the threshold fraction $T_R$. On the other hand, when the updated minimum overlap value is greater than the split threshold fraction $T_R^{split}$, the device maintains (646) clustering of the two audio sources.

In some embodiments, after (648) clustering the two audio sources together and passage of a time interval Δt, the device measures (650) an updated angle θ' formed according to rays from an updated location of the listener to updated points in the virtual environment corresponding to the two audio sources. When the updated angle θ' is greater than a predetermined split threshold angle $T_\theta^{split}$, the device de-clusters (652) the two audio sources. The predetermined split threshold angle $T_\theta^{split}$ is greater than the threshold angle $T_\theta$. On the other hand, when the updated angle θ' is less than the split threshold angle $T_\theta^{split}$, the device maintains (654) clustering of the two audio sources.

While the method 600 includes a number of operations shown in a specific order, the method 600 is not limited to this specific set of operations or this specific order. Some embodiments include more or fewer operations. In some instances, the operations can be executed serially or in parallel, the order of two or more operations may be changed, and/or two or more operations may be combined into a single operation.

In addition to the criteria for clustering, each implementation also has criteria to recognize when sources should be split from their clusters (forming new smaller clusters). A good implementation does not quickly split then merge sources again. To avoid this, the thresholds used for clustering and de-clustering are not the same. For example, when the angle threshold $T_\theta$ is 10°, a reasonable value for the split angle threshold $T_\theta^{split}$ is 12°. To form a cluster, the spread of the audio sources has to be less than 10°, but to split up an existing cluster requires an angular spread of 12° or more. Similarly, if the overlap threshold $T_R$ is 0.5, a reasonable value for the split overlap threshold $T_R^{split}$ is 0.25. In this case, there must be at least 50% overlap in order to make a cluster, but the overlap has to fall below 25% to break up an existing cluster. The difference between the splitting and clustering thresholds is sometimes referred to as hysteresis.

Some embodiments iterate the following clustering algorithm at the beginning of each simulation update. The main steps of this algorithm are:

1. Room Estimation: Trace a small number of rays (e.g., 10) to estimate the current size of the bounding box (e.g., room) containing each listener and source.
2. Split Previous Clusters: Check each source to determine if it should be split from its cluster on the previous frame (e.g. overlap$<T_R^{split}$ or $\theta>T_\theta^{split}$. If so, make the source an orphan.
3. Update Cluster Bounds: Update the bounding box of the cluster geometry after sources have potentially been removed. In some embodiments, the bounding box for a cluster is the average of its constituent source bounding boxes.
4. Cluster Sources: For each orphan source, try to cluster it with an existing cluster. If that fails, create a new cluster for the source. For sources that are already part of a cluster, try to merge that cluster with other existing clusters using the same clustering heuristics.

This algorithm creates clusters that attempt to minimize perceivable error in the audio while also clustering aggressively. When sources are clustered, the impact is that all sources within a cluster will emit the same sound (a mix of their anechoic audio) from the union of their geometry. All sources within a cluster are treated as a single "source" within the simulation, and are rendered together as a single "source."

The foregoing description, for purpose of explanation, has been described with reference to specific embodiments. However, the discussions above are not intended to be exhaustive or to limit the scope of the claims to the precise forms disclosed. Many modifications and variations are possible in view of the above teachings. The embodiments were chosen in order to best explain the principles underlying the claims and their practical applications, to thereby enable others skilled in the art to best use the embodiments with various modifications as are suited to the particular uses contemplated.

What is claimed is:

1. A method of clustering audio sources in virtual environments, comprising:

at a virtual-reality device displaying a virtual environment:

identifying two audio sources in the virtual environment;

for each of the two audio sources, determining a respective bounding box in the virtual environment, wherein the respective bounding box includes termination points for a respective plurality of rays emanating from a respective point in the virtual environment corresponding to the respective audio source;

applying an overlap test to the bounding boxes to determine whether the two audio sources are in a same room;

identifying a location of a listener in the virtual environment;

forming an angle θ according to rays from the location of the listener to the points in the virtual environment corresponding to the two audio sources; and when the two audio sources are determined to be in the same room and the angle θ is less than a predetermined threshold angle $T_\theta$, clustering the two audio sources together, including rendering combined audio for the two audio sources, from a single cluster audio location.

2. The method of claim 1, wherein applying the overlap test comprises determining whether overlap between the two bounding boxes is more than a threshold fraction of each bounding box.

3. The method of claim 2, wherein the bounding boxes are $R_1$ and $R_2$, and applying the overlap test comprises:

determining respective volumes $|R_1|_v$ and $|R_2|_v$ for the bounding boxes $R_1$ and $R_2$;

determining a volume $|R_1 \cap R_2|_v$ of the overlap between the two bounding boxes;

computing a minimum overlap value $$\min\left(\frac{|R_1 \cap R_2|_v}{|R_1|_v}, \frac{|R_1 \cap R_2|_v}{|R_2|_v}\right); \text{ and}$$

determining that the two audio sources are in the same room when the minimum overlap value exceeds a threshold fraction $T_R$.

4. The method of claim 3, further comprising after clustering the two audio sources together and passage of a time interval Δt:

determining updated respective volumes $|R_1'|_v$ and $|R_2'|_v$ for updated bounding boxes $R_1'$ and $R_2'$ corresponding to the two audio sources;

determining an updated volume $|R_1' \cap R_2'|_v$ of overlap between the two updated bounding boxes;

computing an updated minimum overlap value $$\min\left(\frac{|R_1' \cap R_2'|_v}{|R_1'|_v}, \frac{|R_1' \cap R_2'|_v}{|R_2'|_v}\right);$$

when the updated minimum overlap value is less than a predetermined split threshold fraction $T_R^{split}$, de-clustering the two audio sources, wherein the predetermined split threshold fraction $T_R^{split}$ is less than the threshold fraction $T_R$; and when the updated minimum overlap value is greater than the split threshold fraction $T_R^{split}$, maintaining clustering of the two audio sources.

5. The method of claim 1, wherein each termination point of a respective ray emanating from a respective point corresponding to a respective audio source comprises a location in the virtual environment where either (1) the respective ray encounters an object in the virtual environment or (2) the respective ray exits from the virtual environment.

6. The method of claim 5, wherein the virtual environment has perpendicular coordinate axes, and each bounding box is a minimal axis-aligned rectangle containing the termination points of its respective plurality of rays.

7. The method of claim 1, wherein the single cluster audio location is a centroid of the points in the virtual environment corresponding to the two audio sources.

8. The method of claim 1, wherein:

when the two audio sources are determined not to be in the same room or the angle θ is greater than the threshold angle $T_\theta$, forgoing clustering of the two audio sources, rendering audio for the virtual environment without combining audio for the two audio sources.

9. The method of claim 1, further comprising after clustering the two audio sources together and passage of a time interval Δt:

forming an updated angle θ' according to rays from an updated location of the listener to updated points in the virtual environment corresponding to the two audio sources;

when the updated angle θ' is greater than a predetermined split threshold angle $T_\theta^{split}$, de-clustering the two audio sources, wherein the predetermined split threshold angle $T_\theta^{split}$ is greater than the threshold angle $T_\theta$; and when the updated angle θ' is less than the split threshold angle $T_\theta^{split}$, maintaining clustering of the two audio sources.

10. A virtual-reality device comprising:

one or more processors;

memory; and one or more programs, stored in the memory, configured for execution by the one or more processors, the one or more programs including instructions for:

identifying two audio sources in the virtual environment;

for each of the two audio sources, determining a respective bounding box in the virtual environment, wherein the respective bounding box includes termination points for a respective plurality of rays emanating from a respective point in the virtual environment corresponding to the respective audio source;

applying an overlap test to the bounding boxes to determine whether the two audio sources are in a same room;

identifying a location of a listener in the virtual environment;

forming an angle θ according to rays from the location of the listener to the points in the virtual environment corresponding to the two audio sources; and when the two audio sources are determined to be in the same room and the angle θ is less than a predetermined threshold angle $T_\theta$, clustering the two audio sources together, including rendering combined audio for the two audio sources, from a single cluster audio location.

11. The device of claim 10, wherein applying the overlap test comprises determining whether overlap between the two bounding boxes is more than a threshold fraction of each bounding box.

12. The device of claim 11, wherein the bounding boxes are $R_1$ and $R_2$, and applying the overlap test comprises:

determining respective volumes $|R_1|_v$ and $|R_2|_v$ for the bounding boxes $R_1$ and $R_2$;

determining a volume $|R_1 \cap R_2|_v$ of the overlap between the two bounding boxes;

computing a minimum overlap value $$\min\left(\frac{|R_1 \cap R_2|_v}{|R_1|_v}, \frac{|R_1 \cap R_2|_v}{|R_2|_v}\right); \text{ and}$$

determining that the two audio sources are in the same room when the minimum overlap value exceeds a threshold fraction $T_R$.

13. The device of claim 12, wherein the one or more programs further include instructions that execute after clustering the two audio sources together and passage of a time interval Δt, including instructions for:

determining updated respective volumes $|R_1'|_v$ and $|R_2'|_v$ for updated bounding boxes $R_1'$ and $R_2'$ corresponding to the two audio sources;

determining an updated volume $|R_1' \cap R_2'|_v$ of overlap between the two updated bounding boxes;

computing an updated minimum overlap value $$\min\left(\frac{|R_1' \cap R_2'|_v}{|R_1'|_v}, \frac{|R_1' \cap R_2'|_v}{|R_2'|_v}\right);$$

when the updated minimum overlap value is less than a predetermined split threshold fraction $T_R^{split}$, de-clustering the two audio sources, wherein the predetermined split threshold fraction $T_R^{split}$ is less than the threshold fraction $T_R$; and when the updated minimum overlap value is greater than the split threshold fraction $T_R^{split}$, maintaining clustering of the two audio sources.

14. The device of claim 10, wherein each termination point of a respective ray emanating from a respective point corresponding to a respective audio source comprises a location in the virtual environment where either (1) the respective ray encounters an object in the virtual environment or (2) the respective ray exits from the virtual environment.

15. The device of claim 14, wherein the virtual environment has perpendicular coordinate axes, and each bounding box is a minimal axis-aligned rectangle containing the termination points of its respective plurality of rays.

16. The device of claim 10, wherein the single cluster audio location is a centroid of the points in the virtual environment corresponding to the two audio sources.

17. The device of claim 10, wherein:

when the two audio sources are determined not to be in the same room or the angle θ is greater than the threshold angle $T_\theta$, forgoing clustering of the two audio sources, rendering audio for the virtual environment without combining audio for the two audio sources.

18. The device of claim 10, wherein the one or more programs further include instructions that execute after clustering the two audio sources together and passage of a time interval Δt, including instructions for:

forming an updated angle θ' according to rays from an updated location of the listener to updated points in the virtual environment corresponding to the two audio sources;

when the updated angle θ' is greater than a predetermined split threshold angle $T_\theta^{split}$, de-clustering the two audio sources, wherein the predetermined split threshold angle $T_\theta^{split}$ is greater than the threshold angle $T_\theta$; and when the updated angle θ' is less than the split threshold angle $T_\theta^{split}$ maintaining clustering of the two audio sources.

19. A non-transitory computer-readable storage medium, storing one or more programs configured for execution by one or more processors of a virtual-reality device, the one or more programs including instructions for:

identifying two audio sources in the virtual environment;

for each of the two audio sources, determining a respective bounding box in the virtual environment, wherein the respective bounding box includes termination points for a respective plurality of rays emanating from a respective point in the virtual environment corresponding to the respective audio source;

applying an overlap test to the bounding boxes to determine whether the two audio sources are in a same room;

identifying a location of a listener in the virtual environment;

forming an angle θ according to rays from the location of the listener to the points in the virtual environment corresponding to the two audio sources; and when the two audio sources are determined to be in the same room and the angle θ is less than a predetermined threshold angle $T_\theta$, clustering the two audio sources together, including rendering combined audio for the two audio sources, from a single cluster audio location.

20. The computer-readable storage medium of claim 19, wherein the one or more programs further include instructions that execute after clustering the two audio sources together and passage of a time interval Δt, including instructions for:

forming an updated angle θ' according to rays from an updated location of the listener to updated points in the virtual environment corresponding to the two audio sources;

when the updated angle θ' is greater than a predetermined split threshold angle $T_\theta^{split}$, de-clustering the two audio sources, wherein the predetermined split threshold angle $T_\theta^{split}$ is greater than the threshold angle $T_\theta$; and when the updated angle θ' is less than the split threshold angle $T_\theta^{split}$, maintaining clustering of the two audio sources.

* * * * *